US008261839B2

(12) United States Patent
Fripp et al.

(10) Patent No.: US 8,261,839 B2
(45) Date of Patent: Sep. 11, 2012

(54) VARIABLE FLOW RESISTANCE SYSTEM FOR USE IN A SUBTERRANEAN WELL

(75) Inventors: Michael L. Fripp, Carrollton, TX (US); Jason D. Dykstra, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/792,117

(22) Filed: Jun. 2, 2010

(65) Prior Publication Data

US 2011/0297384 A1 Dec. 8, 2011

(51) Int. Cl.
*E21B 34/08* (2006.01)
*F15C 1/16* (2006.01)

(52) U.S. Cl. ..... 166/373; 166/386; 166/316; 166/319; 137/808; 137/812

(58) Field of Classification Search ..... 166/316, 166/319, 373, 386; 137/808, 812
See application file for complete search history.

(56) References Cited

U.S. PATENT DOCUMENTS 3,091,393 A 5/1963 Sparrow
3,282,279 A 11/1966 Manion
3,461,897 A 8/1969 Kwok
3,470,894 A 10/1969 Rimmer
3,474,670 A * 10/1969 Rupert ..... 73/861.32
3,489,009 A 1/1970 Rimmer
3,515,160 A * 6/1970 Cohen ..... 137/810
3,529,614 A * 9/1970 Nelson ..... 137/809
3,537,466 A 11/1970 Chapin
3,566,900 A 3/1971 Black
3,598,137 A * 8/1971 Glaze ..... 137/809
3,620,238 A * 11/1971 Minoru ..... 137/810
3,670,753 A 6/1972 Healey
3,704,832 A * 12/1972 Fix et al. ..... 239/461
3,712,321 A * 1/1973 Bauer ..... 137/812
3,717,164 A * 2/1973 Griffin ..... 137/810
3,942,557 A * 3/1976 Tsuchiya ..... 137/810

(Continued)

FOREIGN PATENT DOCUMENTS

EP 0834342 A2 4/1998

(Continued)

OTHER PUBLICATIONS

Office Action issued Jun. 26, 2011 for U.S. Appl. No. 12/791,993, 17 pages.

(Continued)

*Primary Examiner* — Jennifer H Gay
(74) *Attorney, Agent, or Firm* — Smith IP Services, P.C.

(57) ABSTRACT

A variable flow resistance system can include a flow chamber through which a fluid composition flows in a well, the chamber having an inlet and an outlet. The fluid composition enters via the inlet in a direction which changes based on a ratio of desired to undesired fluid in the fluid composition. A well system can include a variable flow resistance system through which a fluid composition flows between a tubular string and a formation, the flow resistance system including a flow chamber through which the fluid composition flows, with only one chamber inlet. The fluid composition flows more directly from the inlet to an outlet as a ratio of desired to undesired fluid in the fluid composition increases. Another flow resistance system can include at least one structure which influences portions of the fluid composition which flow circuitously between the inlet and the outlet to maintain such circuitous flow.

50 Claims, 8 Drawing Sheets

U.S. PATENT DOCUMENTS

| | | | | | |
|---|---|---|---|---|---|
| 4,029,127 | A | * | 6/1977 | Thompson | 137/806 |
| 4,082,169 | A | * | 4/1978 | Bowles | 188/322.14 |
| 4,276,943 | A | | 7/1981 | Holmes | |
| 4,286,627 | A | * | 9/1981 | Graf | 137/810 |
| 4,291,395 | A | * | 9/1981 | Holmes | 367/83 |
| 4,323,991 | A | | 4/1982 | Holmes et al. | |
| 4,385,875 | A | | 5/1983 | Kanazawa | |
| 4,390,062 | A | | 6/1983 | Fox | |
| 4,418,721 | A | | 12/1983 | Holmes | |
| 4,557,295 | A | * | 12/1985 | Holmes | 137/813 |
| 4,562,867 | A | * | 1/1986 | Stouffer | 137/811 |
| 4,570,675 | A | * | 2/1986 | Fenwick et al. | 137/805 |
| 4,801,310 | A | * | 1/1989 | Bielefeldt | 210/788 |
| 4,846,224 | A | * | 7/1989 | Collins et al. | 137/810 |
| 4,848,991 | A | * | 7/1989 | Bielefeldt | 55/399 |
| 4,895,582 | A | * | 1/1990 | Bielefeldt | 55/337 |
| 5,076,327 | A | * | 12/1991 | Mettner | 137/809 |
| 5,303,782 | A | | 4/1994 | Johannessen | |
| 5,455,804 | A | | 10/1995 | Holmes et al. | |
| 5,482,117 | A | | 1/1996 | Kolpak et al. | |
| 5,570,744 | A | | 11/1996 | Weingarten et al. | |
| 6,015,011 | A | | 1/2000 | Hunter | |
| 6,112,817 | A | | 9/2000 | Voll et al. | |
| 6,345,963 | B1 | | 2/2002 | Thomin et al. | |
| 6,367,547 | B1 | | 4/2002 | Towers et al. | |
| 6,371,210 | B1 | | 4/2002 | Bode et al. | |
| 6,374,858 | B1 | * | 4/2002 | Hides et al. | 137/813 |
| 6,497,252 | B1 | | 12/2002 | Kohler et al. | |
| 6,622,794 | B2 | | 9/2003 | Zisk, Jr. | |
| 6,627,081 | B1 | | 9/2003 | Hilditch et al. | |
| 6,644,412 | B2 | | 11/2003 | Bode et al. | |
| 6,691,781 | B2 | | 2/2004 | Grant et al. | |
| 6,719,048 | B1 | | 4/2004 | Ramos et al. | |
| 7,011,101 | B2 | * | 3/2006 | Bowe et al. | 137/14 |
| 7,185,706 | B2 | | 3/2007 | Freyer | |
| 7,290,606 | B2 | | 11/2007 | Coronado et al. | |
| 7,409,999 | B2 | | 8/2008 | Henriksen et al. | |
| 7,537,056 | B2 | | 5/2009 | MacDougall | |
| 7,857,050 | B2 | | 12/2010 | Zazovsky et al. | |
| 2006/0131033 | A1 | | 6/2006 | Bode et al. | |
| 2007/0028977 | A1 | | 2/2007 | Goulet | |
| 2007/0246407 | A1 | | 10/2007 | Richards et al. | |
| 2008/0041580 | A1 | | 2/2008 | Freyer et al. | |
| 2008/0041581 | A1 | | 2/2008 | Richards | |
| 2008/0041582 | A1 | | 2/2008 | Saetre et al. | |
| 2008/0041588 | A1 | | 2/2008 | Richards et al. | |
| 2008/0149323 | A1 | | 6/2008 | O'Malley et al. | |
| 2008/0169099 | A1 | | 7/2008 | Pensgaard | |
| 2008/0283238 | A1 | | 11/2008 | Richards et al. | |
| 2008/0314590 | A1 | | 12/2008 | Patel | |
| 2009/0000787 | A1 | | 1/2009 | Hill et al. | |
| 2009/0065197 | A1 | | 3/2009 | Eslinger | |
| 2009/0078427 | A1 | | 3/2009 | Patel | |
| 2009/0078428 | A1 | | 3/2009 | Ali | |
| 2009/0101354 | A1 | | 4/2009 | Holmes et al. | |
| 2009/0133869 | A1 | | 5/2009 | Clem | |
| 2009/0151925 | A1 | | 6/2009 | Richards et al. | |
| 2009/0226301 | A1 | * | 9/2009 | Priestman et al. | 415/145 |
| 2009/0250224 | A1 | | 10/2009 | Wright et al. | |
| 2009/0277650 | A1 | | 11/2009 | Casciaro et al. | |
| 2010/0300568 | A1 | * | 12/2010 | Faram et al. | 137/810 |
| 2011/0042091 | A1 | * | 2/2011 | Dykstra et al. | 166/316 |
| 2011/0042092 | A1 | * | 2/2011 | Fripp et al. | 166/319 |
| 2011/0079384 | A1 | | 4/2011 | Russell et al. | |
| 2011/0186300 | A1 | | 8/2011 | Dykstra et al. | |
| 2011/0198097 | A1 | | 8/2011 | Moen | |
| 2011/0203671 | A1 | * | 8/2011 | Doig | 137/1 |
| 2011/0214876 | A1 | * | 9/2011 | Dykstra et al. | 166/316 |
| 2011/0297384 | A1 | | 12/2011 | Fripp et al. | |
| 2011/0297385 | A1 | | 12/2011 | Dykstra et al. | |
| 2012/0060624 | A1 | | 3/2012 | Dykstra | |
| 2012/0061088 | A1 | | 3/2012 | Dykstra et al. | |

FOREIGN PATENT DOCUMENTS

| | | | |
|---|---|---|---|
| EP | 2146049 | A2 | 1/2007 |
| EP | 1857633 | A2 | 11/2007 |
| WO | 0214647 | A1 | 2/2002 |
| WO | 03062597 | A1 | 7/2003 |
| WO | 2004033063 | A2 | 4/2004 |
| WO | 2008024645 | A2 | 2/2008 |
| WO | 2009052076 | A2 | 4/2009 |
| WO | 2009052103 | A2 | 4/2009 |
| WO | 2009052149 | A2 | 4/2009 |
| WO | 2009081088 | A2 | 7/2009 |
| WO | 2009088292 | A1 | 7/2009 |
| WO | 2009088293 | A1 | 7/2009 |
| WO | 2009088624 | A2 | 7/2009 |
| WO | 2010053378 | A2 | 5/2010 |
| WO | 2010087719 | A1 | 8/2010 |
| WO | 2011095512 | A2 | 8/2011 |
| WO | 2011115494 | A1 | 9/2011 |

OTHER PUBLICATIONS

Joseph M. Kirchner, "Fluid Amplifiers", 1996, 6 pages, McGraw-Hill, New York.

Joseph M. Kirchner, et al., "Design Theory of Fluidic Components", 1975, 9 pages, Academic Press, New York.

Microsoft Corporation, "Fluidics" article, Microsoft Encarta Online Encyclopedia, copyright 1997-2009, 1 page, USA.

The Lee Company Technical Center, "Technical Hydraulic Handbook" 11th Edition, copyright 1971-2009, 7 pages, Connecticut.

Lee Precision Micro Hydraulics, Lee Restrictor Selector product brochure; Jan. 2011, 9 pages.

Tesar, V.; Fluidic Valves for Variable-Configuration Gas Treatment; Chemical Engineering Research and Design journal; Sep. 2005; pp. 1111-1121, 83(A9); Trans IChemE; Rugby, Warwickshire, UK.

Tesar, V.; Sampling by Fluidics and Microfluidics; Acta Polytechnica; Feb. 2002; pp. 41-49; vol. 42; The University of Sheffield; Sheffield, UK.

Tesar, V., Konig, A., Macek, J., and Baumruk, P.; New Ways of Fluid Flow Control in Automobiles: Experience with Exhaust Gas Aftertreament Control; 2000 FISITA World Automotive Congress; Jun. 12-15, 2000; 8 pages; F2000H192; Seoul, Korea.

International Search Report and Written Opinion issued Mar. 25, 2011 for International Patent Application Serial No. PCT/US2010/044409, 9 pages.

International Search Report and Written Opinion issued Mar. 31, 2011 for International Patent Application Serial No. PCT/US2010/044421, 9 pages.

International Search Report with Written Opinion issued Jan. 5, 2012 for PCT Patent Application No. PCT/US2011/047925, 9 pages.

Stanley W. Angrist; "Fluid Control Devices", published Dec. 1964, 5 pages.

Office Action issued Nov. 2, 2011 for U.S. Appl. No. 12/792,146, 34 pages.

Office Action issued Nov. 3, 2011 for U.S. Appl. No. 13/111,169, 16 pages.

Office Action issued Oct. 27, 2011 for U.S. Appl. No. 12/791,993, 15 pages.

Stanley W. Angrist; "Fluid Control Devices", Scientific American Magazine, dated Dec. 1964, 8 pages.

Rune Freyer et al.; "An Oil Selective Inflow Control System", Society of Petroleum Engineers Inc. paper, SPE 78272, dated Oct. 29-31, 2002, 8 pages.

Office Action issued Oct. 26, 2011 for U.S. Appl. No. 13/111,169, 28 pages.

Patent Application and Drawings for U.S. Appl. No. 13/351,035, filed Jan. 16, 2012, 62 pages.

Patent Application and Drawings for U.S. Appl. No. 13/359,617, filed Jan. 27, 2012, 42 pages.

Patent Application and Drawings for U.S. Appl. No. 12/958,625, filed Dec. 2, 2010, 37 pages.

Patent Application and Drawings for U.S. Appl. No. 12/974,212, filed Dec. 21, 2010, 41 pages.

Office Action issued Mar. 8, 2012 for U.S. Appl. No. 12/792,146, 26 pages.

Patent Application and Drawings for U.S. Appl. No. 13/084,025, filed Apr. 11, 2011, 45 pages.

Office Action issued May 24, 2012 for U.S. Appl. No. 12/869,836, 60 pages.

Office Action issued May 24, 2012 for U.S. Appl. No. 13/430,507, 17 pages.
International Search Report with Written Opinion issued Mar. 26, 2012 for PCT Patent Application No. PCT/US11/048986, 9 pages.
International Search Report with Written Opinion issued Apr. 17, 2012 for PCT Patent Application No. PCT/US11/050255, 9 pages.

* cited by examiner

VARIABLE FLOW RESISTANCE SYSTEM FOR USE IN A SUBTERRANEAN WELL

CROSS-REFERENCE TO RELATED APPLICATIONS

This application is related to prior application Ser. No. 12/700,685 filed on 4 Feb. 2010, which is a continuation-in-part of application Ser. No. 12/542,695 filed on 18 Aug. 2009. The entire disclosures of these prior applications are incorporated herein by this reference for all purposes.

BACKGROUND

This disclosure relates generally to equipment utilized and operations performed in conjunction with a subterranean well and, in an example described below, more particularly provides a variable flow resistance system.

In a hydrocarbon production well, it is many times beneficial to be able to regulate flow of fluids from an earth formation into a wellbore. A variety of purposes may be served by such regulation, including prevention of water or gas coning, minimizing sand production, minimizing water and/or gas production, maximizing oil and/or gas production, balancing production among zones, etc.

In an injection well, it is typically desirable to evenly inject water, steam, gas, etc., into multiple zones, so that hydrocarbons are displaced evenly through an earth formation, without the injected fluid prematurely breaking through to a production wellbore. Thus, the ability to regulate flow of fluids from a wellbore into an earth formation can also be beneficial for injection wells.

Therefore, it will be appreciated that advancements in the art of variably restricting fluid flow in a well would be desirable in the circumstances mentioned above, and such advancements would also be beneficial in a wide variety of other circumstances.

SUMMARY

In the disclosure below, a variable flow resistance system is provided which brings improvements to the art of regulating fluid flow in wells. One example is described below in which characteristics of a fluid composition (such as viscosity, density, velocity, etc.) determine a resistance to flow of the fluid composition through the system. Another example is described below in which the resistance to flow of the fluid composition through the system varies based on a ratio of desired fluid to undesired fluid in the fluid composition.

In one aspect, the disclosure provides to the art a variable flow resistance system for use in a subterranean well. The system can include a flow chamber through which a fluid composition flows in the well. The chamber has an inlet and an outlet. The fluid composition enters the chamber via the inlet in a direction which changes based on a ratio of desired fluid to undesired fluid in the fluid composition.

In another aspect, a well system is provided by the disclosure. The well system can include a variable flow resistance system through which a fluid composition flows between a tubular string and an earth formation surrounding a wellbore of the well system. The variable flow resistance system includes a flow chamber through which the fluid composition flows. The chamber has an outlet and only one inlet. The fluid composition flows more directly from the inlet to the outlet as a ratio of desired fluid to undesired fluid in the fluid composition increases.

In yet another aspect, a variable flow resistance system can include a flow chamber through which a fluid composition flows in a subterranean well. The chamber has an inlet, an outlet, and at least one structure which influences portions of the fluid composition which flow circuitously between the inlet and the outlet to maintain such circuitous flow.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
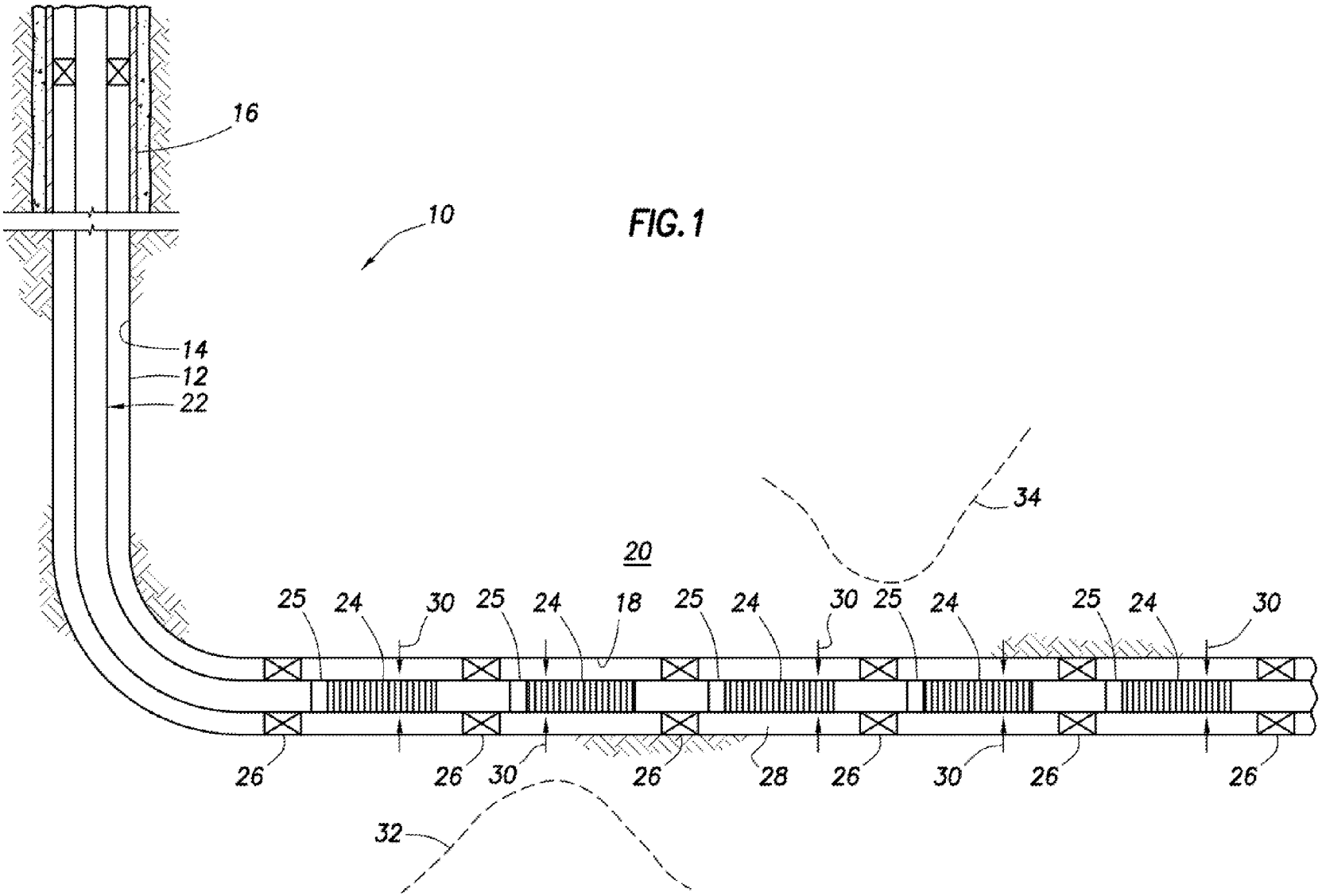
FIG. 1 is a schematic partially cross-sectional view of a well system which can embody principles of the present disclosure.

Representatively illustrated in FIG. 1 is a well system 10 which can embody principles of this disclosure. As depicted in FIG. 1, a wellbore 12 has a generally vertical uncased section 14 extending downwardly from casing 16, as well as a generally horizontal uncased section 18 extending through an earth formation 20.

A tubular string 22 (such as a production tubing string) is installed in the wellbore 12. Interconnected in the tubular string 22 are multiple well screens 24, variable flow resistance systems 25 and packers 26.

The packers 26 seal off an annulus 28 formed radially between the tubular string 22 and the wellbore section 18. In this manner, fluids 30 may be produced from multiple intervals or zones of the formation 20 via isolated portions of the annulus 28 between adjacent pairs of the packers 26.

Positioned between each adjacent pair of the packers 26, a well screen 24 and a variable flow resistance system 25 are interconnected in the tubular string 22. The well screen 24 filters the fluids 30 flowing into the tubular string 22 from the annulus 28. The variable flow resistance system 25 variably restricts flow of the fluids 30 into the tubular string 22, based on certain characteristics of the fluids.

At this point, it should be noted that the well system 10 is illustrated in the drawings and is described herein as merely one example of a wide variety of well systems in which the principles of this disclosure can be utilized. It should be clearly understood that the principles of this disclosure are not limited at all to any of the details of the well system 10, or components thereof, depicted in the drawings or described herein.

For example, it is not necessary in keeping with the principles of this disclosure for the wellbore 12 to include a generally vertical wellbore section 14 or a generally horizontal wellbore section 18. It is not necessary for fluids 30 to be only produced from the formation 20 since, in other examples, fluids could be injected into a formation, fluids could be both injected into and produced from a formation, etc.

It is not necessary for one each of the well screen 24 and variable flow resistance system 25 to be positioned between each adjacent pair of the packers 26. It is not necessary for a single variable flow resistance system 25 to be used in conjunction with a single well screen 24. Any number, arrangement and/or combination of these components may be used.

It is not necessary for any variable flow resistance system 25 to be used with a well screen 24. For example, in injection operations, the injected fluid could be flowed through a variable flow resistance system 25, without also flowing through a well screen 24.

It is not necessary for the well screens 24, variable flow resistance systems 25, packers 26 or any other components of the tubular string 22 to be positioned in uncased sections 14, 18 of the wellbore 12. Any section of the wellbore 12 may be cased or uncased, and any portion of the tubular string 22 may be positioned in an uncased or cased section of the wellbore, in keeping with the principles of this disclosure.

It should be clearly understood, therefore, that this disclosure describes how to make and use certain examples, but the principles of the disclosure are not limited to any details of those examples. Instead, those principles can be applied to a variety of other examples using the knowledge obtained from this disclosure.

It will be appreciated by those skilled in the art that it would be beneficial to be able to regulate flow of the fluids 30 into the tubular string 22 from each zone of the formation 20, for example, to prevent water coning 32 or gas coning 34 in the formation. Other uses for flow regulation in a well include, but are not limited to, balancing production from (or injection into) multiple zones, minimizing production or injection of undesired fluids, maximizing production or injection of desired fluids, etc.

Examples of the variable flow resistance systems 25 described more fully below can provide these benefits by increasing resistance to flow if a fluid velocity increases beyond a selected level (e.g., to thereby balance flow among zones, prevent water or gas coning, etc.), increasing resistance to flow if a fluid viscosity or density decreases below a selected level (e.g., to thereby restrict flow of an undesired fluid, such as water or gas, in an oil producing well), and/or increasing resistance to flow if a fluid viscosity or density increases above a selected level (e.g., to thereby minimize injection of water in a steam injection well).

As used herein, the term "viscosity" is used to indicate any of the rheological properties including kinematic viscosity, yield strength, viscoplasticity, surface tension, wettability, etc.

Whether a fluid is a desired or an undesired fluid depends on the purpose of the production or injection operation being conducted. For example, if it is desired to produce oil from a well, but not to produce water or gas, then oil is a desired fluid and water and gas are undesired fluids. If it is desired to produce gas from a well, but not to produce water or oil, the gas is a desired fluid, and water and oil are undesired fluids. If it is desired to inject steam into a formation, but not to inject water, then steam is a desired fluid and water is an undesired fluid.

Note that, at downhole temperatures and pressures, hydrocarbon gas can actually be completely or partially in liquid phase. Thus, it should be understood that when the term "gas" is used herein, supercritical, liquid and/or gaseous phases are included within the scope of that term.

Figure 2:
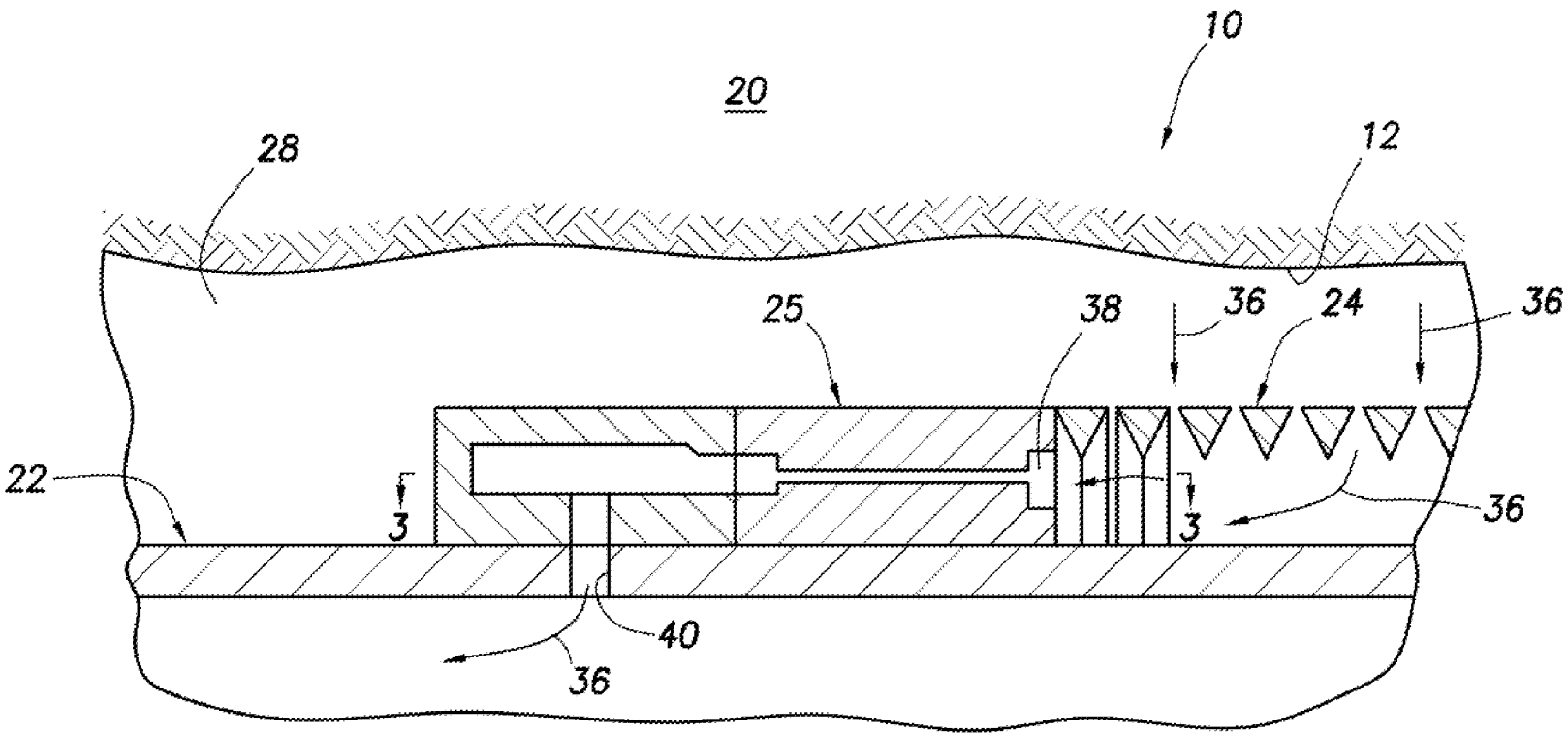
FIG. 2 is an enlarged scale schematic cross-sectional view of a well screen and a variable flow resistance system which may be used in the well system of FIG. 1.

Referring additionally now to FIG. 2, an enlarged scale cross-sectional view of one of the variable flow resistance systems 25 and a portion of one of the well screens 24 is representatively illustrated. In this example, a fluid composition 36 (which can include one or more fluids, such as oil and water, liquid water and steam, oil and gas, gas and water, oil, water and gas, etc.) flows into the well screen 24, is thereby filtered, and then flows into an inlet 38 of the variable flow resistance system 25.

A fluid composition can include one or more undesired or desired fluids. Both steam and water can be combined in a fluid composition. As another example, oil, water and/or gas can be combined in a fluid composition.

Flow of the fluid composition 36 through the variable flow resistance system 25 is resisted based on one or more characteristics (such as density, viscosity, velocity, etc.) of the fluid composition. The fluid composition 36 is then discharged from the variable flow resistance system 25 to an interior of the tubular string 22 via an outlet 40.

In other examples, the well screen 24 may not be used in conjunction with the variable flow resistance system 25 (e.g., in injection operations), the fluid composition 36 could flow in an opposite direction through the various elements of the well system 10 (e.g., in injection operations), a single variable flow resistance system could be used in conjunction with multiple well screens, multiple variable flow resistance systems could be used with one or more well screens, the fluid composition could be received from or discharged into regions of a well other than an annulus or a tubular string, the fluid composition could flow through the variable flow resistance system prior to flowing through the well screen, any other components could be interconnected upstream or downstream of the well screen and/or variable flow resistance system, etc. Thus, it will be appreciated that the principles of this disclosure are not limited at all to the details of the example depicted in FIG. 2 and described herein.

Although the well screen 24 depicted in FIG. 2 is of the type known to those skilled in the art as a wire-wrapped well screen, any other types or combinations of well screens (such as sintered, expanded, pre-packed, wire mesh, etc.) may be used in other examples. Additional components (such as shrouds, shunt tubes, lines, instrumentation, sensors, inflow control devices, etc.) may also be used, if desired.

The variable flow resistance system 25 is depicted in simplified form in FIG. 2, but in a preferred example the system can include various passages and devices for performing various functions, as described more fully below. In addition, the system 25 preferably at least partially extends circumferentially about the tubular string 22, or the system may be formed in a wall of a tubular structure interconnected as part of the tubular string.

In other examples, the system 25 may not extend circumferentially about a tubular string or be formed in a wall of a tubular structure. For example, the system 25 could be formed in a flat structure, etc. The system 25 could be in a separate housing that is attached to the tubular string 22, or it could be oriented so that the axis of the outlet 40 is parallel to the axis of the tubular string. The system 25 could be on a logging string or attached to a device that is not tubular in shape. Any orientation or configuration of the system 25 may be used in keeping with the principles of this disclosure.

Figure 3B:
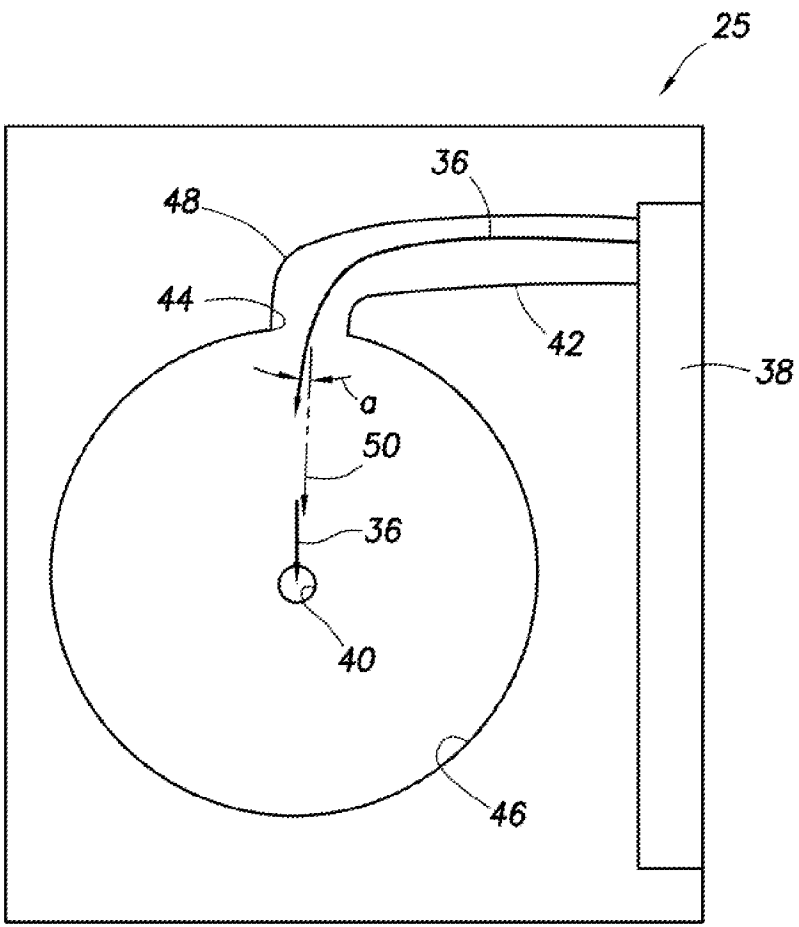
FIGS. 3A & B are schematic "unrolled" plan views of one configuration of the variable flow resistance system, taken along line 3-3 of FIG. 2.
Figure 3A:
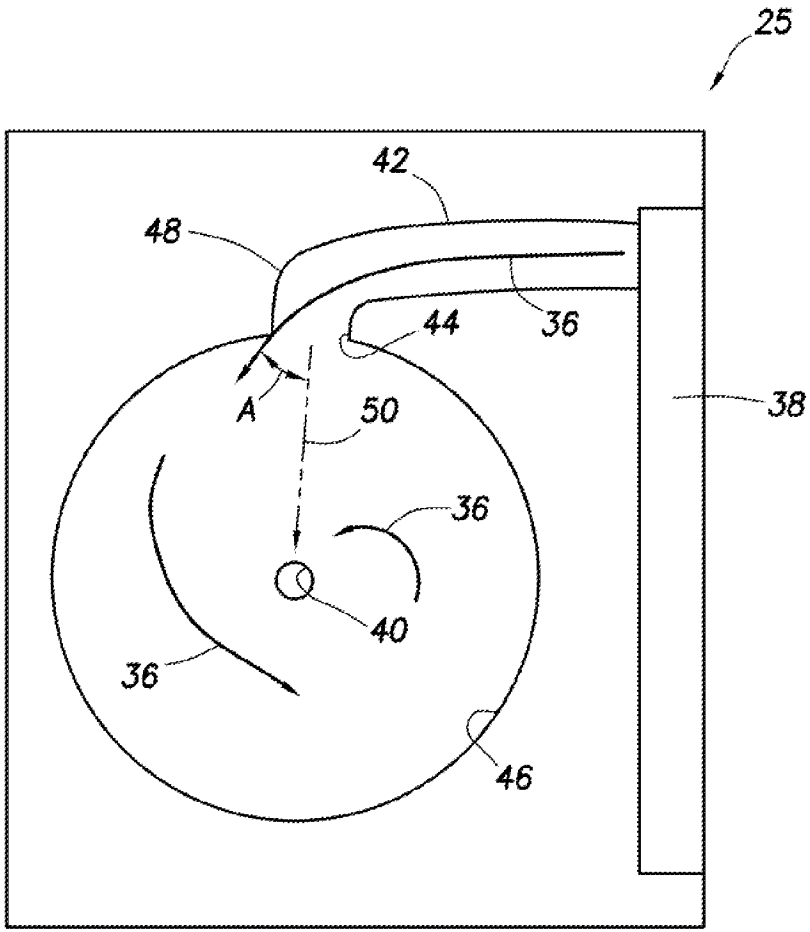

Referring additionally now to FIGS. 3A & B, a more detailed cross-sectional view of one example of the system 25 is representatively illustrated. The system 25 is depicted in FIGS. 3A & B as if it is "unrolled" from its circumferentially extending configuration to a generally planar configuration.

As described above, the fluid composition 36 enters the system 25 via the inlet 38, and exits the system via the outlet 40. A resistance to flow of the fluid composition 36 through the system 25 varies based on one or more characteristics of the fluid composition.

In FIG. 3A, a relatively high velocity, low viscosity and/or high density fluid composition 36 flows through a flow passage 42 from the system inlet 38 to an inlet 44 of a flow chamber 46. The flow passage 42 has an abrupt change in direction 48 just upstream of the inlet 44. The abrupt change in direction 48 is illustrated as a relatively small radius ninety degree curve in the flow passage 42, but other types of direction changes may be used, if desired.

As depicted in FIG. 3A, the chamber 46 is generally cylindrical-shaped and, prior to the abrupt change in direction 48, the flow passage 42 directs the fluid composition 36 to flow generally tangentially relative to the chamber. Because of the relatively high velocity, low viscosity and/or high density of the fluid composition 36, it does not closely follow the abrupt change in direction 48, but instead continues into the chamber 46 via the inlet 44 in a direction which is substantially angled (see angle A in FIG. 3A) relative to a straight direction 50 from the inlet 44 to the outlet 40. The fluid composition 36 will, thus, flow circuitously from the inlet 44 to the outlet 40, eventually spiraling inward to the outlet.

In contrast, a relatively low velocity, high viscosity and/or low density fluid composition 36 flows through the flow passage 42 to the chamber inlet 44 in FIG. 3B. Note that the fluid composition 36 in this example more closely follows the abrupt change in direction 48 of the flow passage 42 and, therefore, flows through the inlet 44 into the chamber 46 in a direction which is only slightly angled (see angle a in FIG. 3B) relative to the straight direction 50 from the inlet 44 to the outlet 40. The fluid composition 36 in this example will, thus, flow much more directly from the inlet 44 to the outlet 40.

Note that, as depicted in FIG. 3B, the fluid composition 36 also exits the chamber 46 via the outlet 40 in a direction which is only slightly angled relative to the straight direction 50 from the inlet 44 to the outlet 40. Thus, the fluid composition 36 exits the chamber 46 in a direction which changes based on velocity, viscosity, density and/or the ratio of desired fluid to undesired fluid in the fluid composition.

It will be appreciated that the much more circuitous flow path taken by the fluid composition 36 in the example of FIG. 3A consumes more of the fluid composition's energy at the same flow rate and, thus, results in more resistance to flow, as compared to the much more direct flow path taken by the fluid composition in the example of FIG. 3B. If oil is a desired fluid, and water and/or gas are undesired fluids, then it will be appreciated that the variable flow resistance system 25 of FIGS. 3A & B will provide less resistance to flow of the fluid composition 36 when it has an increased ratio of desired to undesired fluid therein, and will provide greater resistance to flow when the fluid composition has a decreased ratio of desired to undesired fluid therein.

Since the chamber 46 has a generally cylindrical shape as depicted in the examples of FIGS. 3A & B, the straight direction 50 from the inlet 44 to the outlet 40 is in a radial direction. The flow passage 42 upstream of the abrupt change in direction 48 is directed generally tangential relative to the chamber 46 (i.e., perpendicular to a line extending radially from the center of the chamber). However, the chamber 46 is not necessarily cylindrical-shaped and the straight direction 50 from the inlet 44 to the outlet 40 is not necessarily in a radial direction, in keeping with the principles of this disclosure.

Since the chamber 46 in this example has a cylindrical shape with a central outlet 40, and the fluid composition 36 (at least in FIG. 3A) spirals about the chamber, increasing in velocity as it nears the outlet, driven by a pressure differential from the inlet 44 to the outlet, the chamber may be referred to as a "vortex" chamber.

Figure 4B:
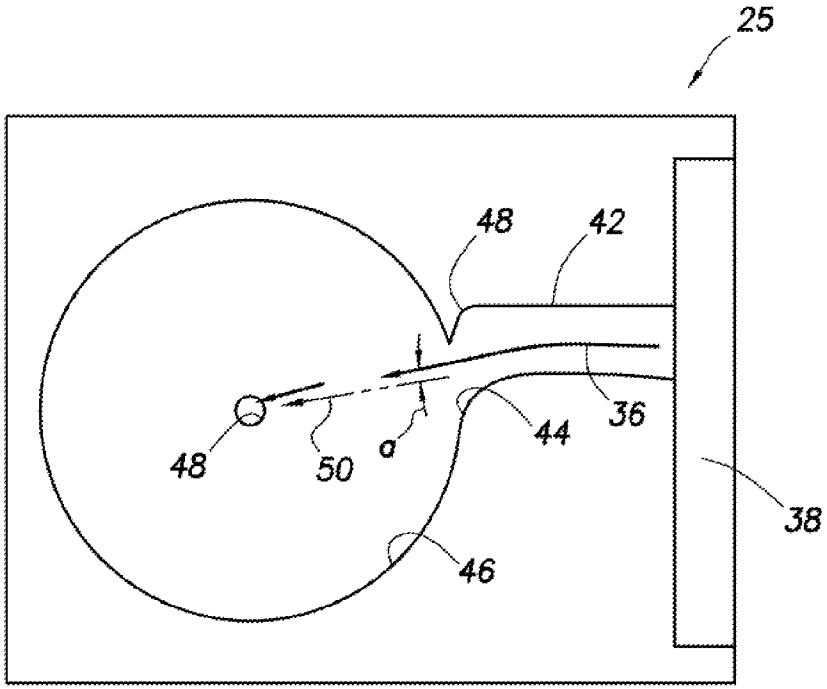
FIGS. 4A & B are schematic plan views of another configuration of the variable flow resistance system.
Figure 4A:
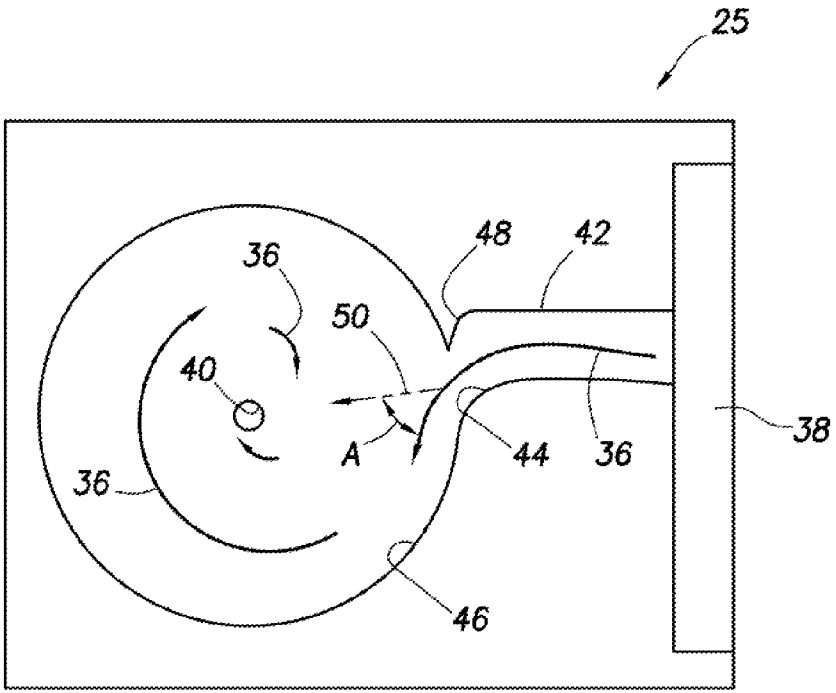

Referring additionally now to FIGS. 4A & B, another configuration of the variable flow resistance system 25 is representatively illustrated. The configuration of FIGS. 4A & B is similar in many respects to the configuration of FIGS. 3A & B, but differs at least in that the flow passage 42 extends much more in a radial direction relative to the chamber 46 upstream of the abrupt change in direction 48, and the abrupt change in direction influences the fluid composition 36 to flow away from the straight direction 50 from the inlet 44 to the outlet 40.

In FIG. 4A, a relatively high viscosity, low velocity and/or low density fluid composition 36 is influenced by the abrupt change in direction 48 to flow into the chamber 46 in a direction away from the straight direction 50 (e.g., at a relatively large angle A to the straight direction). Thus, the fluid composition 36 will flow circuitously about the chamber 46 prior to exiting via the outlet 40.

Note that this is the opposite of the situation described above for FIG. 3B, in which the relatively high viscosity, low velocity and/or low density fluid composition 36 enters the chamber 46 via the inlet 44 in a direction which is only slightly angled relative to the straight direction 50 from the inlet to the outlet 40. However, a similarity of the FIGS. 3B & 4A configurations is that the fluid composition 36 tends to change direction with the abrupt change in direction 48 in the flow passage 42.

In contrast, a relatively high velocity, low viscosity and/or high density fluid composition 36 flows through the flow passage 42 to the chamber inlet 44 in FIG. 4B. Note that the fluid composition 36 in this example does not closely follow the abrupt change in direction 48 of the flow passage 42 and, therefore, flows through the inlet 44 into the chamber 46 in a direction which is angled only slightly relative to the straight direction 50 from the inlet 44 to the outlet 40. The fluid composition 36 in this example will, thus, flow much more directly from the inlet 44 to the outlet 40.

It will be appreciated that the much more circuitous flow path taken by the fluid composition 36 in the example of FIG. 4A consumes more of the fluid composition's energy at the same flow rate and, thus, results in more resistance to flow, as compared to the much more direct flow path taken by the fluid composition in the example of FIG. 4B. If gas or steam is a desired fluid, and water and/or oil are undesired fluids, then it will be appreciated that the variable flow resistance system 25 of FIGS. 4A & B will provide less resistance to flow of the fluid composition 36 when it has an increased ratio of desired to undesired fluid therein, and will provide greater resistance to flow when the fluid composition has a decreased ratio of desired to undesired fluid therein.

Figure 5B:
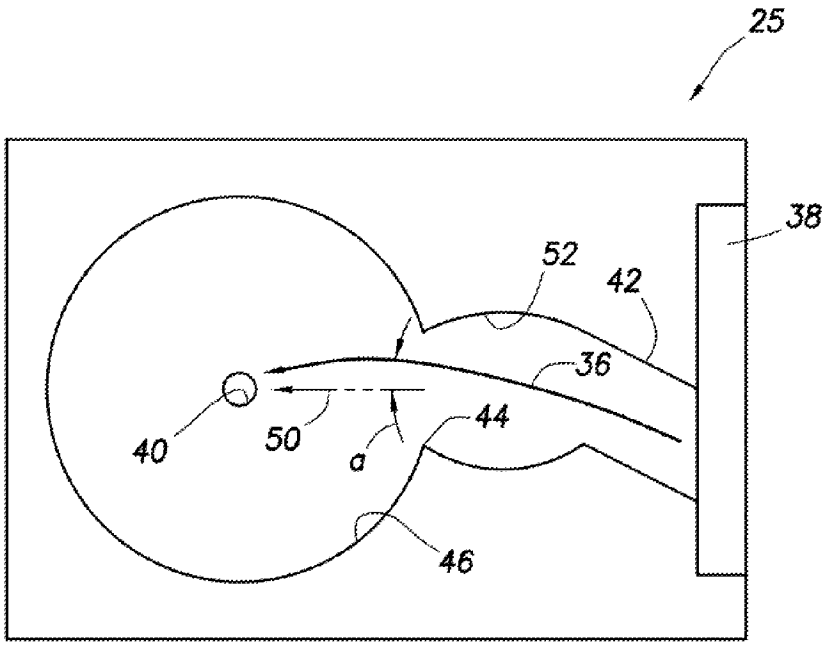
FIGS. 5A & B are schematic plan views of another configuration of the variable flow resistance system.
Figure 5A:
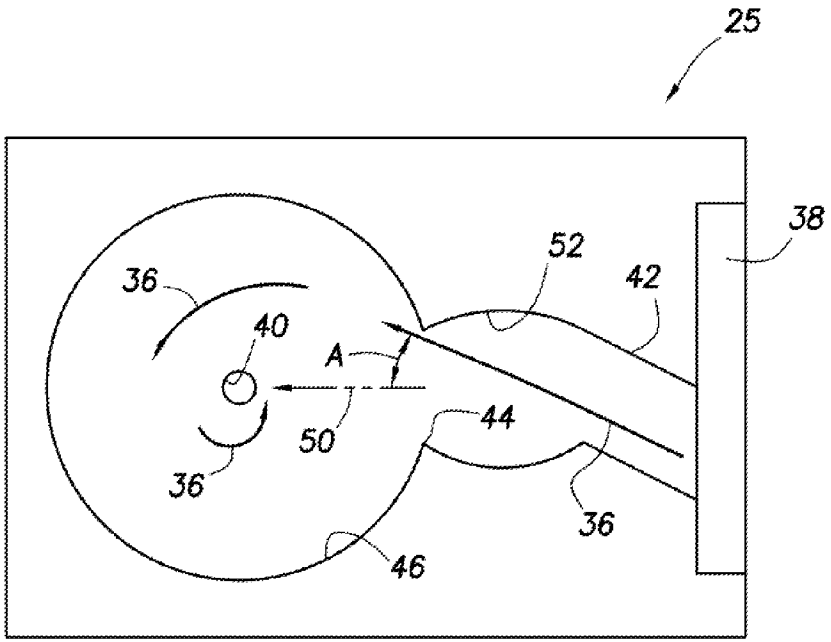

Referring additionally now to FIGS. 5A & B, another configuration of the variable flow resistance system 25 is representatively illustrated. The variable flow resistance system 25 of FIGS. 5A & B is similar in many respects to that of FIGS. 3A & B, but differs at least in that the flow passage 42 is neither radially nor tangentially aligned relative to the chamber 46, and there is not an abrupt change in direction of the flow passage just upstream of the chamber inlet 44 (although in other examples an abrupt change in direction could be used with a flow passage that is not radially or tangentially aligned with a flow chamber).

In FIG. 5A, a relatively high velocity, low viscosity and/or high density fluid composition 36 enters the chamber 46 via the inlet 44 at a relatively large angle A relative to a straight direction 50 from the inlet to the outlet 40. The fluid composition 36, thus, flows circuitously through the chamber 46, eventually spiraling inward to the outlet 40.

The flow passage 42 has an increased flow volume 52 just upstream of the chamber inlet 44, but the fluid composition 36 in the example of FIG. 5A for the most part does not change direction in the increased flow volume prior to flowing into the chamber 46. In the example of FIG. 5B, however, the fluid composition 36 has a lower velocity, increased viscosity and/or decreased density, and the fluid composition does take advantage of the increased flow volume 52 to change direction prior to flowing into the chamber 46 via the inlet 44.

It will be appreciated that the much more circuitous flow path taken by the fluid composition 36 in the example of FIG. 5A consumes more of the fluid composition's energy at the same flow rate and, thus, results in more resistance to flow, as compared to the much more direct flow path taken by the fluid composition in the example of FIG. 5B. If oil is a desired fluid, and water and/or gas are undesired fluids, then it will be appreciated that the variable flow resistance system 25 of FIGS. 5A & B will provide less resistance to flow of the fluid composition 36 when it has an increased ratio of desired to undesired fluid therein, and will provide greater resistance to flow when the fluid composition has a decreased ratio of desired to undesired fluid therein.

The angle of the flow passage 42 relative to the chamber 46 (e.g., with respect to a radius of the chamber) can be varied to thereby produce a corresponding varied resistance to flow of fluids with certain velocities, viscosities, densities, etc. In addition, characteristics (such as dimensions, position, etc.) of the increased flow volume 52 can be varied as desired to change the resistance provided by the system 25 to flow of particular fluids.

Figure 6B:
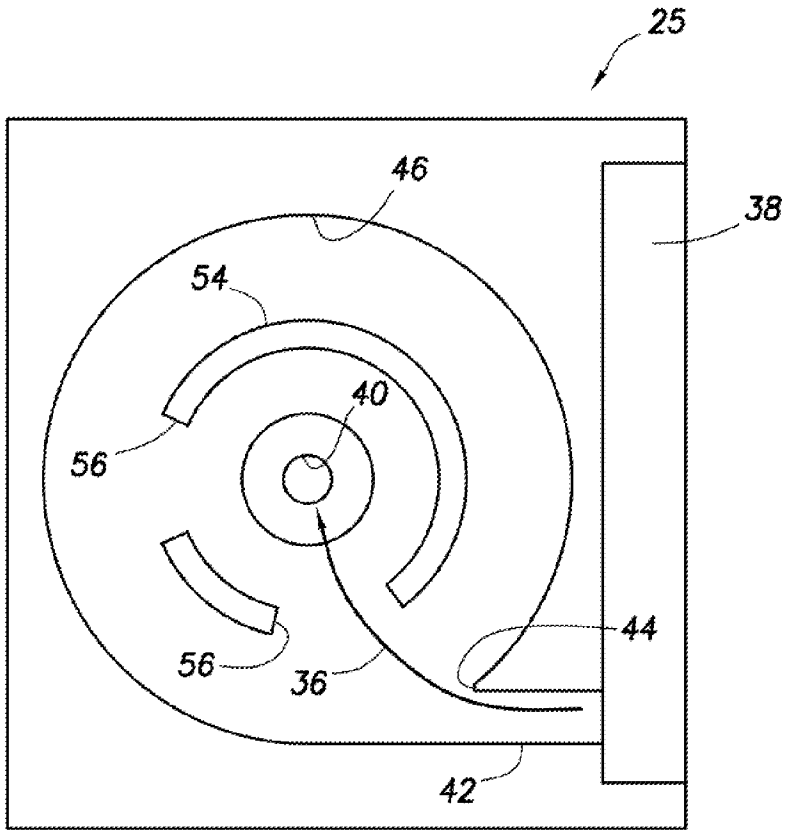
FIGS. 6A & B are schematic plan view of yet another configuration of the variable flow resistance system.
Figure 6A:
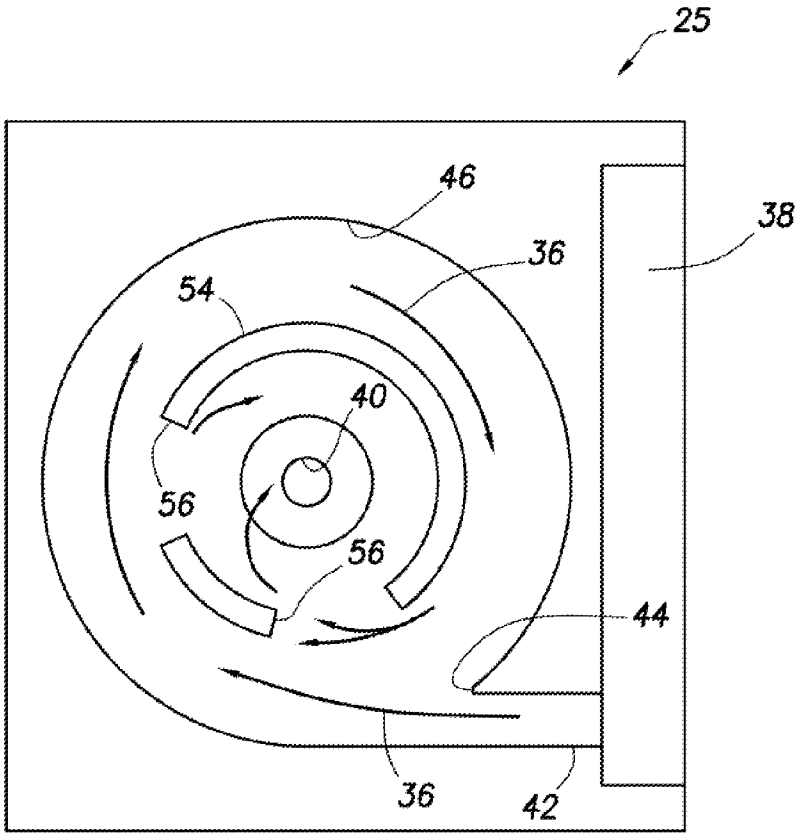

Referring additionally now to FIGS. 6A & B, another configuration of the variable flow resistance system 25 is representatively illustrated. The variable flow resistance system 25 of FIGS. 6A & B is similar in many respects to that of FIGS. 3A & B, but differs at least in that the configuration of FIGS. 6A & B includes a structure 54 in the chamber 46, and there is not an abrupt change in direction of the flow passage 42 just upstream of the chamber inlet 44 (although in other examples an abrupt change in direction could be used in a system which also includes a structure in a flow chamber).

In FIG. 6A, a relatively high velocity, low viscosity and/or high density fluid composition 36 enters the chamber 46 via the inlet 44 and is influenced by the structure 54 to continue to flow about the chamber. The fluid composition 36, thus, flows circuitously through the chamber 46, eventually spiraling inward to the outlet 40 as it gradually bypasses the structure 54 via openings 56.

In FIG. 6B, however, the fluid composition 36 has a lower velocity, increased viscosity and/or decreased density. The fluid composition 36 in this example is able to change direction more readily as it flows into the chamber 46 via the inlet 44, allowing it to flow relatively directly from the inlet to the outlet 40 via an opening 56.

Although the fluid composition 36 is depicted in FIG. 6B as flowing directly from the inlet 44 to the outlet 40 via an opening 56 therebetween, it should be understood that it is not necessary for the fluid composition to flow directly from the inlet to the outlet when the resistance to flow is reduced in the system 25, and it is not necessary for one of the openings 56 to be positioned directly between the inlet and the outlet. There can be some rotation of the fluid composition 36 about the outlet 40 when the resistance to flow is reduced in the system 25, but this rotation of the fluid composition will be less than it would be if the fluid composition had an increased velocity, decreased viscosity and/or increased density.

It will be appreciated that the much more circuitous flow path taken by the fluid composition 36 in the example of FIG. 6A consumes more of the fluid composition's energy at the same flow rate and, thus, results in more resistance to flow, as compared to the much more direct flow path taken by the fluid composition in the example of FIG. 6B. If oil is a desired fluid, and water and/or gas are undesired fluids, then it will be appreciated that the variable flow resistance system 25 of FIGS. 6A & B will provide less resistance to flow of the fluid composition 36 when it has an increased ratio of desired to undesired fluid therein, and will provide greater resistance to flow when the fluid composition has a decreased ratio of desired to undesired fluid therein.

The structure 54 may be in the form of one or more circumferentially extending vanes having one or more of the openings 56 between the vane(s). Alternatively, or in addition, the structure 54 could be in the form of one or more circumferentially extending recesses in walls of the chamber 46. The structure 54 could project inwardly and/or outwardly relative to walls of the chamber 46. The structures 54 could be radially or diagonally arranged, cupped, etc. Thus, it will be appreciated that any type of structure which functions to influence the fluid composition 36 to continue to flow circuitously about the chamber 46 may be used in keeping with the principles of this disclosure.

In other examples, the structures 54 could be arranged so that they divert a spiraling (or otherwise circuitous) flow of the fluid composition 36 to a more direct flow toward the outlet 40. For example, radially oriented and/or cupped structures could accomplish this result. Relatively low density, high viscosity and low velocity flows would more readily change direction when encountering such structures.

Of course, the structures 54 depicted in FIGS. 6A & B can also accomplish this result (diverting decreased density, increased viscosity and decreased velocity flows), due to the fact that their presence somewhat obstructs circuitous flow about the outlet 40, and a change in direction is required for any portion of the fluid composition 36 which flows circuitously about the outlet to be diverted toward the outlet. In particular, the openings 56 present opportunities for the fluid composition 36 to change direction and flow more directly toward the outlet 40, and these opportunities will be more readily taken advantage of by decreased density, increased viscosity and decreased velocity fluids. If a desired fluid (such as oil, etc.) has a relatively high viscosity and/or a relatively low density (e.g., as compared to water), then any portion of the fluid composition 36 which flows circuitously about the outlet 40 will be increasingly diverted toward the outlet by the structures 54 as a ratio of desired to undesired fluid in the fluid composition increases.

Although in the examples depicted in FIGS. 3A-6B, only a single inlet 44 is used for admitting the fluid composition 36 into the chamber 46, in other examples multiple inlets could be provided, if desired. The fluid composition 36 could flow into the chamber 46 via multiple inlets 44 simultaneously or separately. For example, different inlets 44 could be used for when the fluid composition 36 has corresponding different characteristics (such as different velocities, viscosities, densities, etc.).

Figure 7A:
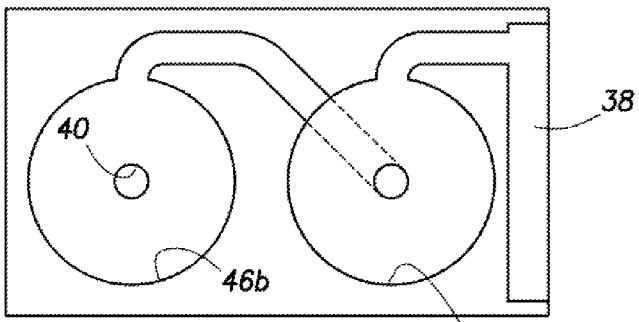
FIGS. 7A-C are schematic plan views of additional configurations of the variable flow resistance system.
Figure 7B:
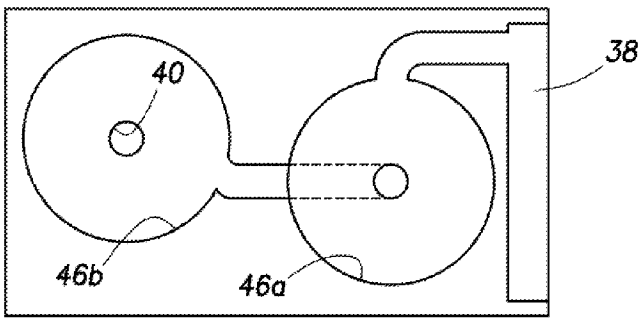
Figure 7C:
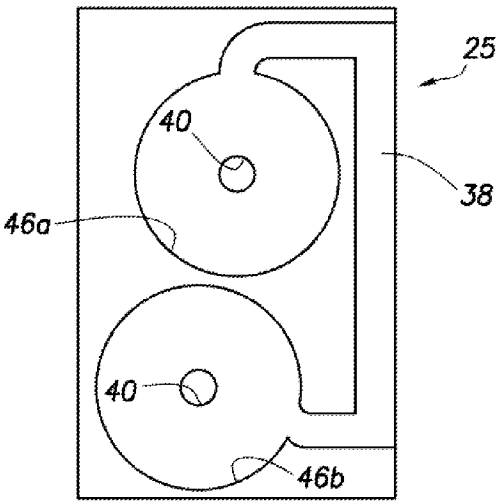

Referring additionally now to FIGS. 7A-C, various arrangements of multiple flow chambers 46 in different configurations of the variable flow resistance system 25 are representatively illustrated. These configurations demonstrate that certain advantages can be achieved by combining multiple flow chambers 46 in a variable flow resistance system 25.

In FIG. 7A, multiple flow chambers 46 of the type depicted in FIGS. 3A & B are connected in series. The fluid composition 36 flows from the inlet 38 to the first chamber 46*a*, then from an outlet of the first chamber to an inlet of a second chamber 46*b*, and then to the outlet 40 of the variable flow resistance system 25.

By combining multiple chambers 46 of the same type in series, the flow resistance effect of the flow resistance system 25 is increased accordingly. Although only two chambers 46*a,b* are depicted in FIG. 7A, any number and any type (such as the other types of chambers depicted in FIGS. 4A-6B) of chambers can be connected in series in keeping with the principles of this disclosure.

In FIG. 7B, different types of chambers 46 are connected in series. In this example, the first chamber 46*a* is of the type depicted in FIGS. 3A & B, and the second chamber 46*b* is of the type depicted in FIGS. 4A & B.

Figure 7D:
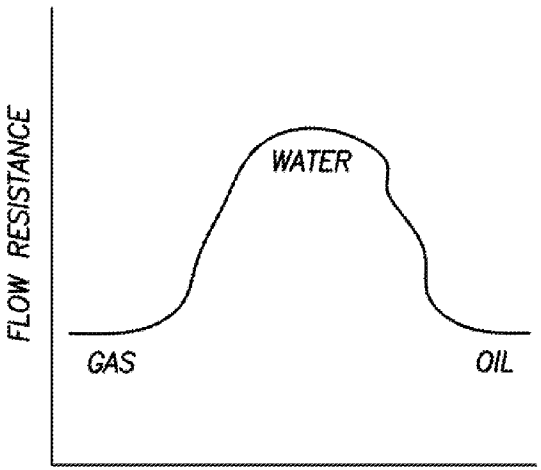
FIG. 7D is a graph of flow resistance versus viscosity for the configuration of FIG. 7C.

By combining multiple chambers 46 of different types in series, the flow resistance effects of the different chambers can be combined to achieve unique relationships between characteristics (such as velocity, viscosity, density, etc.) of the fluid composition 36 flowing through the system 25 and the flow resistance provided by the system. An example of this is depicted in FIG. 7D, and is described more fully below.

Although only two chambers 46*a,b* are depicted in FIG. 7B, any number, any type (such as the other types of chambers depicted in FIGS. 5A-6B) and any combination of chambers can be connected in series in keeping with the principles of this disclosure.

In FIG. 7C, different types of chambers 46 are connected in parallel. In this example, one chamber 46*a* is of the type depicted in FIGS. 3A & B, and the other chamber 46*b* is of the type depicted in FIGS. 4A & B. The fluid composition 36 does not flow from one chamber 46*a* to the other 46*b*, but instead flows through both chambers in parallel.

Similar somewhat to the example of FIG. 7B, combining multiple chambers 46 of different types in parallel can be used to achieve unique relationships between characteristics (such as velocity, viscosity, density, etc.) of the fluid composition 36 flowing through the system 25 and the flow resistance provided by the system.

Although only two chambers 46*a,b* are depicted in FIG. 7C, any number, any type (such as the other types of chambers depicted in FIGS. 5A-6B) and any combination of chambers can be connected in parallel in keeping with the principles of this disclosure. Furthermore, it is not necessary for chambers 46 to be combined only in series or in parallel, since flow chambers could be combined both in series and in parallel in a single variable flow resistance system 25, without departing from the principles of this disclosure.

Referring additionally now to FIG. 7D, a graph of flow resistance versus viscosity is representatively illustrated for the fluid composition 36 flowing through the variable flow resistance system 25. Viscosity of the fluid composition 36 is used as a fluid characteristic in FIG. 7D to demonstrate how the flow resistance of the system 25 can uniquely vary with changes in the fluid characteristic, but it should be clearly understood that the flow resistance of the system can also vary uniquely with respect to other characteristics (such as velocity, density, etc.) of the fluid composition.

In the example of FIG. 7D, multiple chambers 46 are combined in the variable flow resistance system 25 to produce a flow resistance which is relatively high when the fluid composition 36 contains a relatively high proportion of water therein, but the flow resistance is relatively low when the fluid composition contains a relatively high proportion of gas or oil therein. It will be appreciated that this would be highly beneficial in a hydrocarbon production well, in circumstances in which production of oil and gas is desired, but production of water is not desired.

Figure 8:
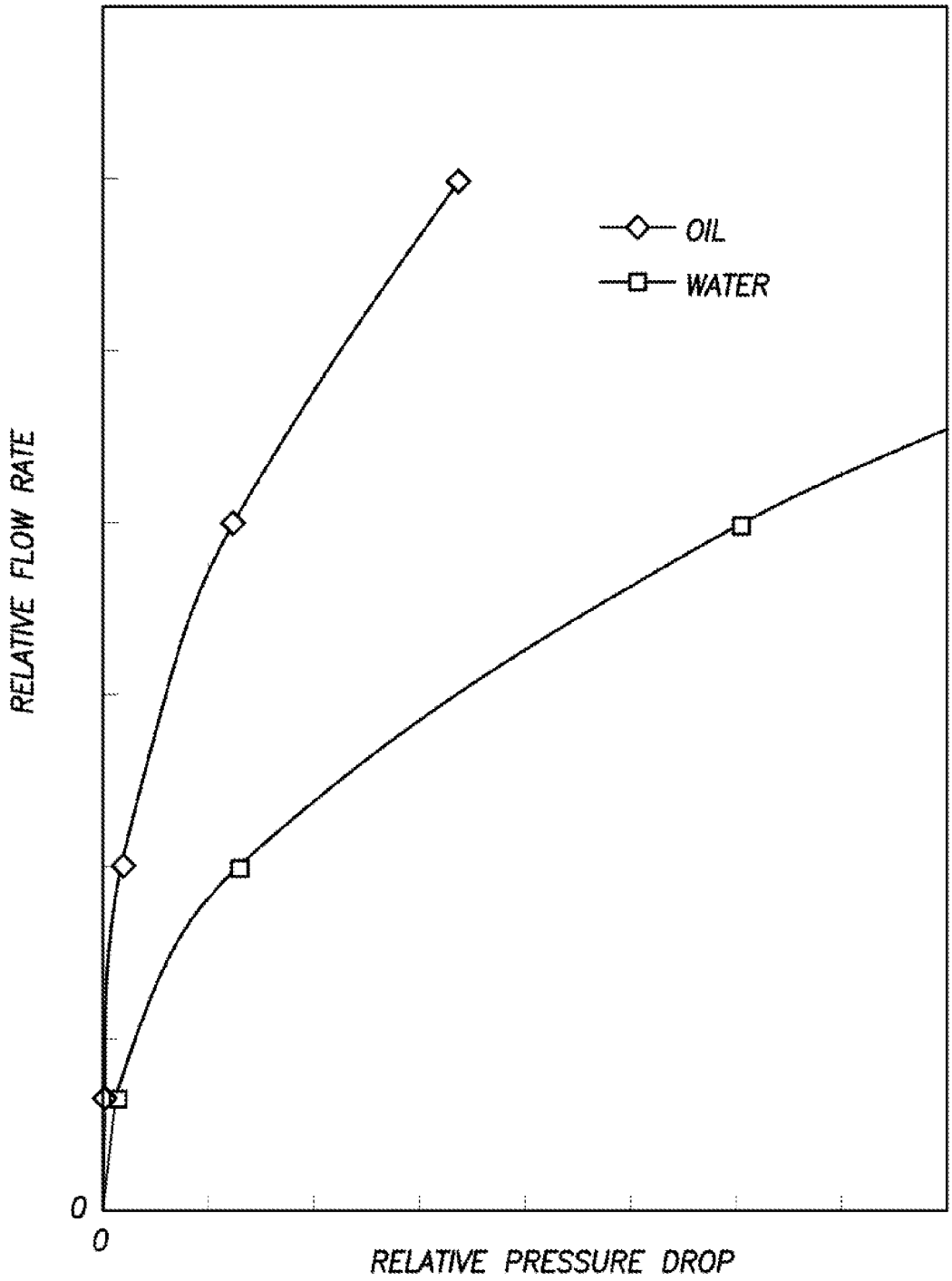
FIG. 8 is a graph of relative pressure drop versus relative flow rate for flow of water and oil through the variable flow resistance system.

Referring additionally now to FIG. 8, an example graph of relative flow rate versus relative pressure drop is provided for different fluids flowed through an example of the variable flow resistance system 25 of the type depicted in FIGS. 6A & B. In this example, a pressure differential across the system 25 is allowed to vary with varied flow rate of the fluid through the system.

The flow rate through the system 25, therefore, provides a convenient indicator of the resistance to flow through the system. However, in actual practice, when the variable flow resistance system 25 is installed in a well, the pressure differential across the system may not vary significantly over time.

As depicted in FIG. 8, at a certain relative pressure drop, oil will have a substantially greater flow rate through the system 25, as compared to the flow rate of water through the system. From another perspective, at a certain relative flow rate, significantly more pressure drop across the system 25 is required, as compared to the pressure drop at the same flow rate of oil. Thus, less resistance is provided to flow of a desired fluid (oil in this case), and greater resistance is provided to flow of an undesired fluid (water in this case).

Although various configurations of the variable flow resistance system 25 have been described above, with each configuration having certain features which are different from the other configurations, it should be clearly understood that those features are not mutually exclusive. Instead, any of the features of any of the configurations of the system 25 described above may be used with any of the other configurations. For example, the structure 54 of the system 25 configuration depicted in FIGS. 6A & B could be used in any of the system configurations of FIGS. 3A-5B, and 7A-C.

It may now be fully appreciated that the above disclosure provides a number of advancements to the art of regulating fluid flow in a well. The variable flow resistance system 25 provides more resistance to flow of the fluid composition 36 when it contains more of an undesired fluid, and the system provides less resistance to flow of the fluid composition when it contains more of a desired fluid. The advantages are obtained, even though the system 25 is relatively straightforward in design, easily and economically constructed, and robust in operation.

In particular, the above disclosure provides to the art a variable flow resistance system 25 for use in a subterranean well. The system 25 can include a flow chamber 46 through which a fluid composition 36 flows in the well. The chamber 46 has an inlet 44 and an outlet 40. The fluid composition 36 enters the chamber 46 via the inlet 44 in a direction which changes based on a ratio of desired fluid to undesired fluid in the fluid composition 36.

In examples described above, the fluid composition 36 may flow into the chamber 46 only via the inlet 44. In other examples, there may be multiple inlets 44 to the chamber 46.

The system 25 can also include a flow passage 42 which directs the fluid composition 36 to the inlet 44. The flow passage 42 may have an abrupt change in direction 48 proximate the inlet 44.

The flow passage 42 upstream of the abrupt change in direction 48 may be aligned generally radially relative to the chamber 46, or may be aligned generally tangentially relative to the chamber 46. In other examples, the flow passage 42 may be aligned neither radially nor tangentially relative to the chamber 46.

The system 25 can include at least one structure 54 which influences any portion of the fluid composition 36 which flows circuitously between the inlet 44 and the outlet 40 to maintain such circuitous flow. The structure 54 may comprise at least one of a vane and a recess. The structure 54 may project inwardly or outwardly relative to a wall of the chamber 46. The structure 54 may have at least one opening 56 which permits the fluid composition 36 to flow directly from the inlet 44 to the outlet 40.

The system 25 can include at least one structure 54 which influences a portion of the fluid composition 36 which flows circuitously between the inlet 44 and the outlet 40 to flow more directly toward the outlet 40. The portion of the fluid composition 36 may be increasingly influenced by the structure 54 to flow more directly toward the outlet 40 as a viscosity of the fluid composition 36 increases, as a density of the fluid composition 36 decreases, as the ration of desired to undesired fluid in the fluid composition 36 increases and/or as a velocity of the fluid composition 36 decreases.

The fluid composition 36 may flow more directly from the inlet 44 to the outlet 40 as a viscosity of the fluid composition 36 increases, as a velocity of the fluid composition decreases, and/or as a density of the fluid composition increases. The fluid composition 36 preferably flows more directly from the inlet 44 to the outlet 40 as the ratio of desired fluid to undesired fluid increases.

A straight direction 50 may extend between the inlet 44 and the outlet 40. The direction the fluid composition 36 enters the chamber 46 via the inlet 44 may be angled relative to the straight direction 50, with the angle (such as angles A and a) being dependent on a characteristic of the fluid composition 36.

The above disclosure also describes a well system 10 which can include a variable flow resistance system 25 through which a fluid composition 36 flows between a tubular string 22 and an earth formation 20 surrounding a wellbore 12 of the well system 10. The variable flow resistance system 25 may include a flow chamber 46 through which the fluid composition 36 flows, with the chamber 46 having an outlet 40 and only one inlet 44. The fluid composition 36 may flow more directly from the inlet 44 to the outlet 40 as a ratio of desired fluid to undesired fluid in the fluid composition 36 increases.

The fluid composition 36 may enter the chamber 46 via the inlet 44 in a direction which changes based on the ratio of desired fluid to undesired fluid in the fluid composition 36. Preferably, a straight direction 50 extends between the inlet 44 and the outlet 40, and the direction the fluid composition 36 enters the chamber 46 via the inlet 44 is angled relative to the straight direction 50, with the angle being dependent on the ratio of desired fluid to undesired fluid in the fluid composition 36.

Also described by the above disclosure is a variable flow resistance system 25 which can include a flow chamber 46 through which a fluid composition 36 flows in the well. The chamber 46 has an inlet 44, an outlet 40, and at least one structure 54 which influences portions of the fluid composition 36 which flow circuitously between the inlet 44 and the outlet 40 to maintain such circuitous flow.

The structure 54 can increasingly influence the portion of the fluid composition 36 which flows circuitously between the inlet 44 and the outlet 40 to flow more directly toward the outlet 40 as a ratio of desired fluid to undesired fluid in the fluid composition 36 increases, as a viscosity of the fluid composition increases, as a density of the fluid composition decreases and/or as a velocity of the fluid composition decreases.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A variable flow resistance system for use in a subterranean well, the system comprising:

a flow chamber through which a fluid composition flows, the chamber having an inlet and an outlet, and wherein the fluid composition enters the chamber via the inlet in a direction which changes based on a ratio of desired fluid to undesired fluid in the fluid composition; and at least one structure which influences a portion of the fluid composition which flows circuitously between the inlet and the outlet to maintain such circuitous flow, wherein the structure has at least one opening which permits the fluid composition to flow directly from the inlet to the outlet.

2. A well system, comprising:

a variable flow resistance system through which a fluid composition flows between a tubular string and an earth formation surrounding a wellbore of the well system, the variable flow resistance system including a flow chamber through which the fluid composition flows, the chamber having an outlet and at least one inlet, and wherein the fluid composition flows more directly from the inlet to the outlet as a ratio of desired fluid to undesired fluid in the fluid composition increases, and the chamber having at least one structure which influences any portion of the fluid composition which flows circuitously between the inlet and the outlet to maintain such circuitous flow.

3. The system of claim 2, wherein the fluid composition moves within the chamber toward the outlet in a direction which changes based on the ratio of desired fluid to undesired fluid in the fluid composition.

4. The system of claim 2, wherein the fluid composition enters the chamber via the inlet in a direction which changes based on the ratio of desired fluid to undesired fluid in the fluid composition.

5. The system of claim 4, wherein a straight direction extends between the inlet and the outlet, and wherein the direction the fluid composition enters the chamber via the inlet is angled relative to the straight direction, with the angle being dependent on the ratio of desired fluid to undesired fluid in the fluid composition.

6. The system of claim 2, further comprising a flow passage which directs the fluid composition to the inlet, and wherein the flow passage has an abrupt change in direction proximate the inlet.

7. The system of claim 6, wherein the flow passage upstream of the abrupt change in direction is aligned generally radially relative to the chamber.

8. The system of claim 6, wherein the flow passage upstream of the abrupt change in direction is aligned generally tangentially relative to the chamber.

9. The system of claim 2, further comprising a flow passage which directs the fluid composition to the inlet, and wherein the flow passage is aligned neither radially nor tangentially relative to the chamber.

10. The system of claim 2, wherein the structure comprises at least one of a vane and a recess.

11. The system of claim 2, wherein the structure projects at least one of inwardly and outwardly relative to a wall of the chamber.

12. The system of claim 2, wherein the structure has at least one opening which permits the fluid composition to flow directly from the inlet to the outlet.

13. The system of claim 2, wherein the fluid composition flows more directly from the inlet to the outlet as a viscosity of the fluid composition increases.

14. The system of claim 2, wherein the fluid composition flows more directly from the inlet to the outlet as a velocity of the fluid composition decreases.

15. The system of claim 2, wherein the fluid composition flows more directly from the inlet to the outlet as a density of the fluid composition decreases.

16. The system of claim 2, wherein the fluid composition flows more directly from the inlet to the outlet as the ratio of desired fluid to undesired fluid increases.

17. A variable flow resistance system for use in a subterranean well, the system comprising:

a flow chamber through which a fluid composition flows in the well, the chamber having an inlet, an outlet, and at least one structure which influences a portion of the fluid composition which flows circuitously between the inlet and the outlet to maintain such circuitous flow, wherein the structure has at least one opening which permits the fluid composition to flow more directly from the inlet to the outlet.

18. The system of claim 17, wherein the structure comprises at least one of a vane and a recess.

19. The system of claim 17, wherein the structure projects at least one of inwardly and outwardly relative to a wall of the chamber.

20. The system of claim 17, wherein the fluid composition enters the chamber via the inlet in a direction which changes based on a ratio of desired fluid to undesired fluid in the fluid composition.

21. The system of claim 20, wherein a straight direction extends between the inlet and the outlet, and wherein the direction the fluid composition enters the chamber via the inlet is angled relative to the straight direction, with the angle being dependent on the ratio of desired fluid to undesired fluid in the fluid composition.

22. The system of claim 17, wherein the fluid composition flows into the chamber only via the inlet.

23. The system of claim 17, further comprising a flow passage which directs the fluid composition to the inlet, and wherein the flow passage has an abrupt change in direction proximate the inlet.

24. The system of claim 23, wherein the flow passage upstream of the abrupt change in direction is aligned generally radially relative to the chamber.

25. The system of claim 23, wherein the flow passage upstream of the abrupt change in direction is aligned generally tangentially relative to the chamber.

26. The system of claim 17, further comprising a flow passage which directs the fluid composition to the inlet, and wherein the flow passage is aligned neither radially nor tangentially relative to the chamber.

27. The system of claim 17, wherein the fluid composition flows more directly from the inlet to the outlet as a viscosity of the fluid composition increases.

28. The system of claim 17, wherein the fluid composition flows more directly from the inlet to the outlet as a velocity of the fluid composition decreases.

29. The system of claim 17, wherein the fluid composition flows more directly from the inlet to the outlet as a density of the fluid composition decreases.

30. The system of claim 17, wherein the fluid composition flows more directly from the inlet to the outlet as a ratio of desired fluid to undesired fluid in the fluid composition increases.

31. The system of claim 17, wherein the structure increasingly influences the portion of the fluid composition which flows circuitously between the inlet and the outlet to flow more directly toward the outlet as a ratio of desired fluid to undesired fluid in the fluid composition increases.

32. The system of claim 17, wherein the structure increasingly influences the portion of the fluid composition which flows circuitously between the inlet and the outlet to flow more directly toward the outlet as a velocity of the fluid composition decreases.

33. A method for varying a flow resistance in a subterranean well, the method comprising the steps of:

flowing a fluid composition through a flow chamber, the chamber having an inlet and an outlet, wherein a direction that the fluid composition enters the chamber via the inlet changes in response to a change in a ratio of desired fluid to undesired fluid in the fluid composition, wherein flowing the fluid composition through the chamber further comprises flowing the fluid composition circuitously between the inlet and the outlet, and influencing a portion of the fluid composition to maintain such circuitous flow via at least one structure, and wherein the at least one structure has at least one opening which permits the fluid composition to flow directly from the inlet to the outlet.

34. The method of claim 33, wherein the flowing step further comprises flowing the fluid composition into the chamber only via the inlet.

35. The method of claim 33, further comprising directing the fluid composition through a flow passage to the inlet, wherein the flow passage has an abrupt change in direction proximate the inlet.

36. The method of claim 35, wherein the flow passage upstream of the abrupt change is aligned generally radially relative to the chamber.

37. The method of claim 35, wherein the flow passage upstream of the abrupt change is aligned generally tangentially relative to the chamber.

38. The method of claim 33, further comprising directing the fluid composition through a flow passage to the inlet, wherein the flow passage is aligned neither radially nor tangentially relative to the chamber.

39. The method of claim 33, wherein the structure comprises at least one of a vane and a recess.

40. The method of claim 33, wherein the structure projects at least one of inwardly and outwardly relative to a wall of the chamber.

41. The method of claim 33, wherein flowing the fluid composition through the chamber further comprises influencing a portion of the fluid composition to flow more directly toward the outlet via the at least one structure.

42. The method of claim 41, wherein influencing the portion of the fluid composition further comprises increasingly influencing the portion of the fluid composition to flow more directly toward the outlet as a viscosity of the fluid composition increases.

43. The method of claim 41, wherein influencing the portion of the fluid composition further comprises increasingly influencing the portion of the fluid composition to flow more directly toward the outlet as a velocity of the fluid composition decreases.

44. The method of claim 41, wherein influencing the portion of the fluid composition further comprises increasingly influencing the portion of the fluid composition to flow more directly toward the outlet as the ratio of desired fluid to undesired fluid in the fluid composition increases.

45. The method of claim 41, wherein influencing the portion of the fluid composition further comprises increasingly influencing the portion of the fluid composition to flow more directly toward the outlet as a density of the fluid composition decreases.

46. The method of claim 33, wherein flowing the fluid composition through the chamber further comprises flowing the fluid composition more directly from the inlet to the outlet as a viscosity of the fluid composition increases.

47. The method of claim 33, wherein flowing the fluid composition through the chamber further comprises flowing the fluid composition more directly from the inlet to the outlet as a velocity of the fluid composition decreases.

48. The method of claim 33, wherein flowing the fluid composition through the chamber further comprises flowing the fluid composition more directly from the inlet to the outlet as a density of the fluid composition decreases.

49. The method of claim 33, wherein flowing the fluid composition through the chamber further comprises flowing the fluid composition more directly from the inlet to the outlet as the ratio of desired fluid to undesired fluid increases.

50. The method of claim 33, wherein a straight direction extends between the inlet and the outlet, and wherein the direction that the fluid composition enters the chamber via the inlet is angled relative to the straight direction, with the angle being dependent on a characteristic of the fluid composition.

* * * * *